US006319135B1

(12) United States Patent
Monson

(10) Patent No.: US 6,319,135 B1
(45) Date of Patent: Nov. 20, 2001

(54) PLAYGROUND EQUIPMENT

(76) Inventor: Alan K. Monson, 8510 Bluebonnet, Amarillo, TX (US) 79108

( * ) Notice: Subject to any disclaimer, the term of this patent is extended or adjusted under 35 U.S.C. 154(b) by 0 days.

(21) Appl. No.: 09/656,178

(22) Filed: Sep. 6, 2000

(51) Int. Cl.[7] ..... A63G 1/16
(52) U.S. Cl. ..... 472/32; 472/33; 472/14
(58) Field of Search ..... 472/14, 19, 29, 472/32, 33, 3, 136, 137

(56) References Cited

U.S. PATENT DOCUMENTS

| | | | | |
|---|---|---|---|---|
| 120,585 | | 11/1871 | Hirons . | |
| 247,858 | | 10/1881 | Thoni . | |
| D. 334,788 | | 4/1993 | Blankenagel . | |
| 555,338 | | 2/1896 | Rodehafer . | |
| 639,386 | | 12/1899 | Hile . | |
| 836,016 | | 11/1906 | Doner . | |
| 938,283 | * | 10/1909 | Smith | 472/32 |
| 1,070,105 | | 8/1913 | Blount . | |
| 1,174,407 | | 3/1916 | Glenn . | |
| 1,588,941 | | 6/1926 | Chapman . | |
| 1,965,039 | | 7/1934 | Hunt . | |
| 3,397,881 | * | 8/1968 | Hedgecock | 472/32 |
| 4,973,042 | | 11/1990 | Klopf et al. . | |
| 5,709,606 | | 1/1998 | Ehrman . | |
| 5,795,235 | * | 8/1998 | Ullrich et al. | 472/14 |
| 5,954,588 | | 9/1999 | Lien . | |

FOREIGN PATENT DOCUMENTS

| | | |
|---|---|---|
| 1807816 | 5/1970 | (DE) . |
| 3430282 A1 | 2/1986 | (DE) . |
| 1496877 | 1/1978 | (GB) . |

* cited by examiner

*Primary Examiner*—Kien T. Nguyen

(57) ABSTRACT

A merry-go-round for playground use comprises a rotating shaft mounted to a support shaft. A frame structure including a spin ring and two seats are mounted to the rotating shaft. Seat belts are provided to strap riders (children) into the seats. The support shaft extends into the ground and incorporates an anchoring system which is encased in concrete. A safety barrier is positioned between the spin ring and the seats. The merry-go-round is operated by a person who manually propels the spin ring mounted to the rotating shaft.

20 Claims, 4 Drawing Sheets

PLAYGROUND EQUIPMENT

BACKGROUND OF THE INVENTION

1. Field of the Invention

The present invention generally relates to amusement rides. More specifically, the present invention is drawn to a manually-operated merry-go-round for children.

2. Description of the Related Art

There are many types of amusement equipment provided for public parks, school playgrounds and other children's play areas. One piece of equipment which has retained popularity for many generations is the merry-go-round. Unfortunately, because of poor design and/or construction which leads to improper use, the merry-go-round has directly or indirectly caused many serious accidents. A safe, durable, manually-operated, uncomplicated and "fun" merry-go-round would certainly be a welcomed addition to the art.

The prior art is replete with variations of merry-go-rounds. For example U.S. Pat. No. 120,585 (Hirons), U.S. Pat. No. 247,858 (Thoni), U.S. Pat. No. 555,338 (Rodehafer), U.S. Pat. No. 639,386 (Hile), U.S. Pat. No. 836,016 (Doner) , U.S. Pat. No. 1,070,105(Blount) and U.S. Pat. No. 1,588,941 (Chapman) show manually operated merry-go-rounds. However, the bases of the merry-go-rounds are not supported in concrete and may be prone to tilt over under certain conditions. Further, no provision is made to prevent participants from wandering in the path of the revolving ride or swing structures.

U.S. Pat. No. 1,174,407 (Glen), British Patent 1,496, 877and German Patent 34 30 282 A1 disclose swings wherein a mechanism employs potential energy of the weight of the swings occupants to provide rotating energy. There is no teaching that the supporting shafts are reinforced and embedded in concrete or that any provision is made to deter collisions with errant participants.

U.S. Pat. No. 1,965,039 (Hunt), U.S. Pat. No. 4,973,042 (Klopf et al.), U.S. Pat. No. 5,709,606 (Ehrman) and U.S. Pat. No. 5,954,588 (Lien) disclose amusement devices that are motorized and require trained operators.

U.S. Pat. No. Des. 334,788 (Blankenagel) shows an ornamental design for a merry-go-round. There is no discussion as to the base support structure.

German Patent number 1,807,816 shows a merry-go-round fixed on the base of a transport vehicle.

None of he above inventions and patents, taken either singularly or in combination, is seen to disclose a manually operated merry-go-round as will subsequently be described and claimed in the instant invention.

SUMMARY OF THE INVENTION

The present invention is drawn to a merry-go-round apparatus for children. As contemplated, the apparatus is adapted to be installed in a playground or play area. The merry-go-round includes a rotating shaft which is mounted on a support shaft. The support shaft employs a unique anchoring system which is encased in concrete thereby providing a stable and safe support for the apparatus. A spin ring is attached to the rotating shaft such that the speed of the merry-go-round may be controlled by a person(s) manually rotating the spin ring. A pair of seats are suspended on chains at diametrically opposite sides of the apparatus. Each seat is equipped with a seat belt or strap. A circular barrier is disposed between the spin ring and the seats to prevent the person(s) at the ring from inadvertently wandering into the path of the rotating seats. Since the person manually rotating the merry-go-round is often a parent with a toddler, a mesh netting is provided on the barrier to prevent the toddler from crawling into the path of the rotating seats.

Accordingly, it is a principal object of the invention to provide amusement apparatus in the form of a merry-go-round for children.

It is another object of the invention to provide a merry-go-round which employs a superior anchoring system.

It is a further object of the invention to provide a merry-go-round wherein the rotating speed is manually controlled.

Still another object of the invention is to provide a merry-go-round which has safety features for protecting all participants.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
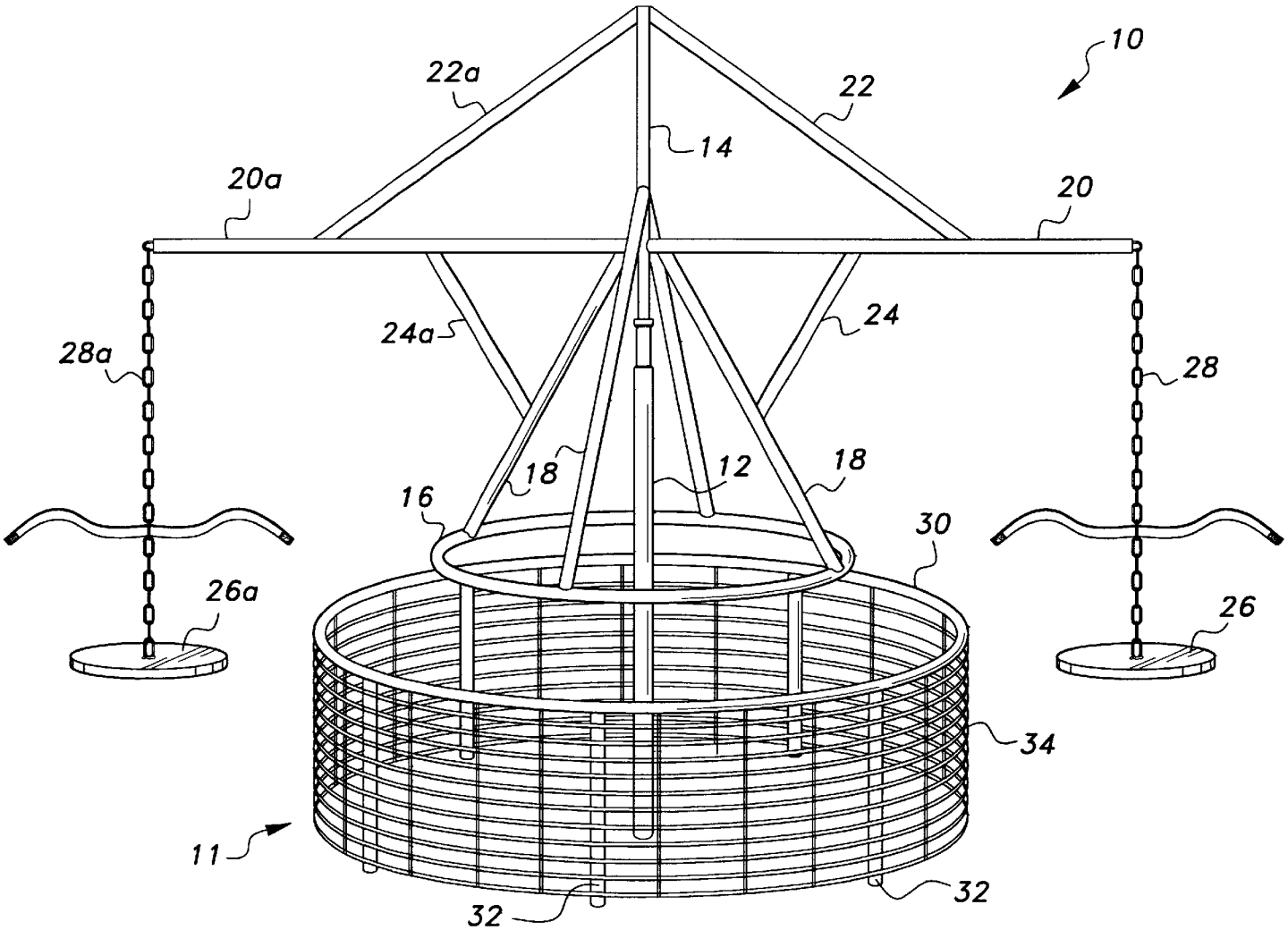
FIG. 1 is an environmental, perspective view of a merry-go-round apparatus according to the present invention.

FIG. 1 illustrates the merry-go-round apparatus of the present invention generally indicated at 10. Merry-go-round 10 comprises a centrally located support shaft 12 which has a rotating shaft 14 mounted thereon. Support shaft 12 extends into the ground and is anchored therein by a unique system as will be explained below. A spin ring 16, having a diameter of approximately five feet, encircles and is supported on rotating shaft 14 via an array of struts 18. Struts 18 are attached to rotary shaft 14 by any 10 efficient and convenient means e.g. welding. A pair of arms 20, 20*a* are attached to and extend horizontally in diametrically opposite directions from rotating shaft 14. Arms 20, 20*a* are further supported by struts 22, 22*a*, 24 and 24*a* in the manner as shown. Seats 26, 26*a* are suspended from the ends of arms 20, 20*a*by respective chain members 28, 28*a*. A safety barrier generally indicated at 11 is spaced from and surrounds support shaft 12. Safety barrier 11 has a diameter of approximately twelve feet. Safety barrier 11 comprises a circular member 30 supported approximately two feet from the ground on a plurality of stakes 32. Stakes 32 are embedded in the ground. A mesh netting 34 is supported on member 30 and extends downward to ground level. As discussed above the safety barrier functions to prevent participants from inadvertently wandering from the area of spin ring 16 into the path of rotating seats 26, 26*a*. As contemplated, the spin ring, struts, arms, circular member and stakes are all fabricated from metal stock (two-six inch pipe). However it is recognized that other materials (plastic, wood, composite, etc.) could be utilized if suitable.

Figure 2:
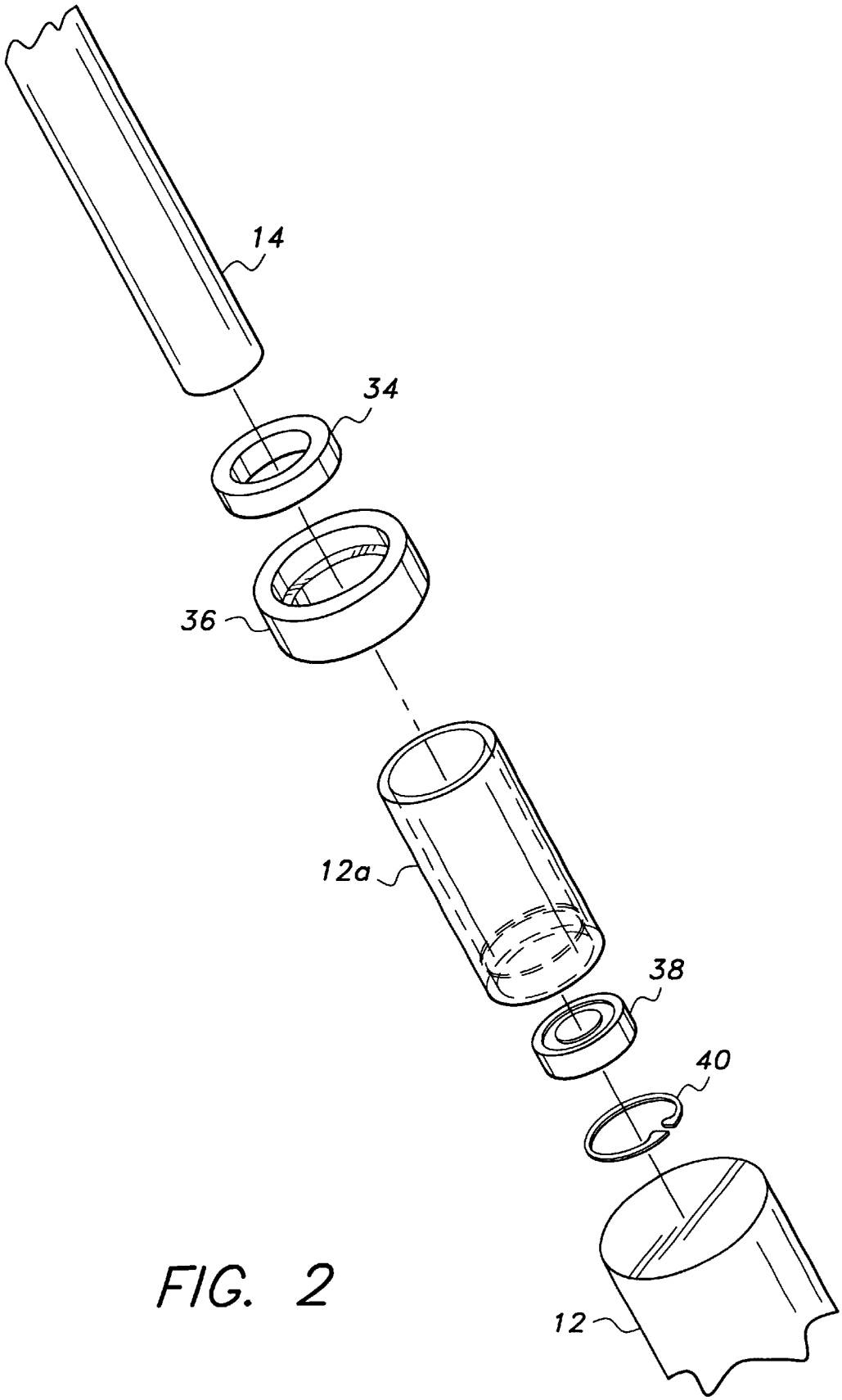
FIG. 2 is a partial, exploded, perspective view of the rotating shaft and support shaft of a merry-go-round apparatus according to the present invention.

Attention is now directed to FIG. 2 which illustrates a more detailed view of the support shaft 12 and rotating shaft 14. Rotating shaft 14 is made from three inch shafting material and is adapted to be inserted for rotation into three inch support pipe 12*a*. Pipe 12*a* is attached to support shaft 12 by welding. Support shaft 12 is fabricated of four inch metal piping. Conventional hardware such as roller bearing 34, bearing housing 36, race 38, and a snap ring 40 for the race are provided to enhance the rotational characteristics of the apparatus. An opening (not shown) is disposed in pipe 12*a* for adding friction reducing grease when necessary.

Figure 3:
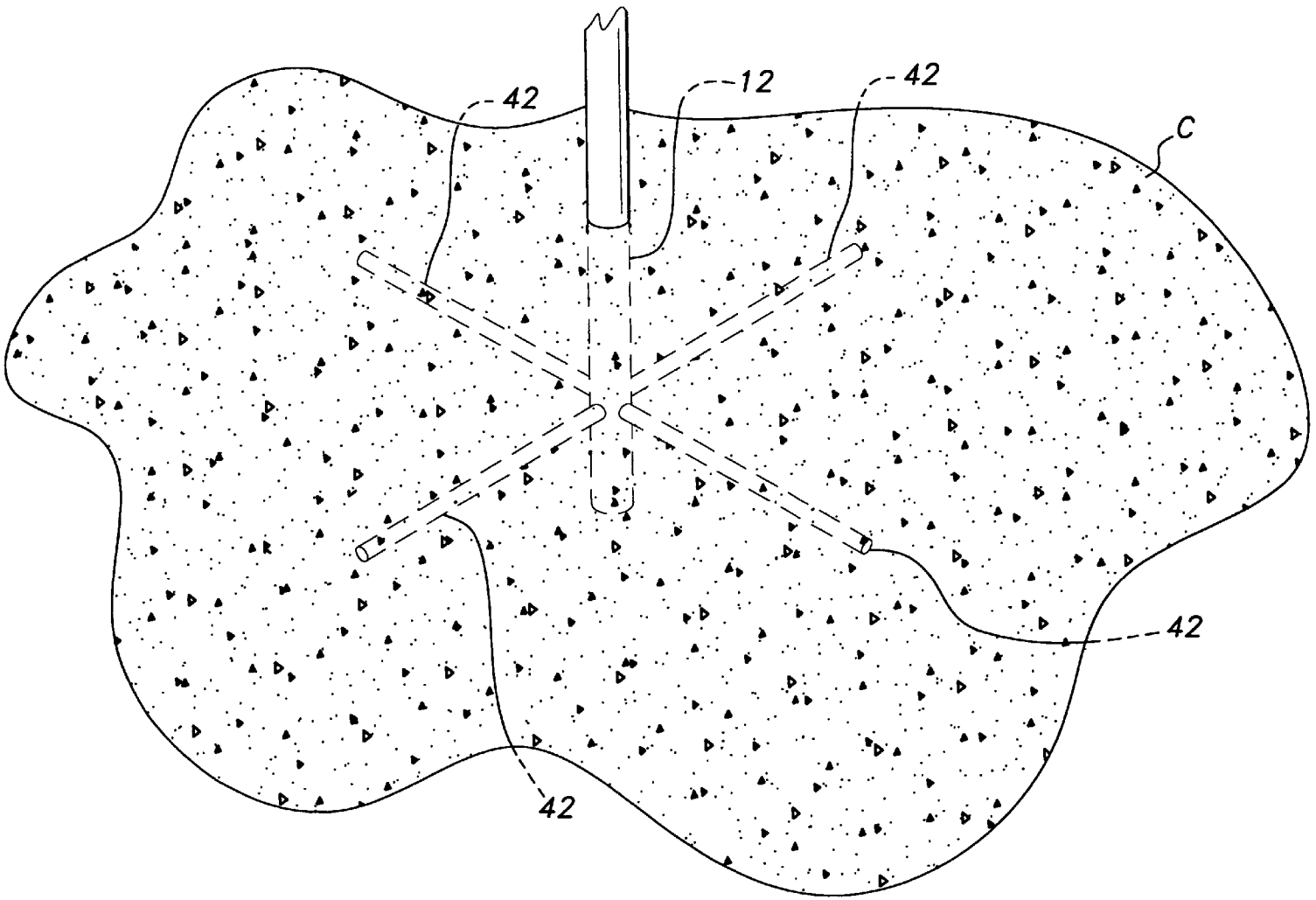
FIG. 3 is a partial, perspective view of the support shaft and anchoring system of a merry-go-round apparatus according to the present invention.

FIG. 3 illustrates the unique anchoring system of the instant invention. Four two inch diameter pipes 42 are attached (welded) to support shaft 12 adjacent the lower end thereof and extend radially therefrom. The lower end of support shaft 12 along with pipes 42 inserted in the ground and encased in concrete C. This arrangement provides a sturdy and stable base for the merry-go-round of the instant invention making tip over impossible under normal conditions.

Figure 4:
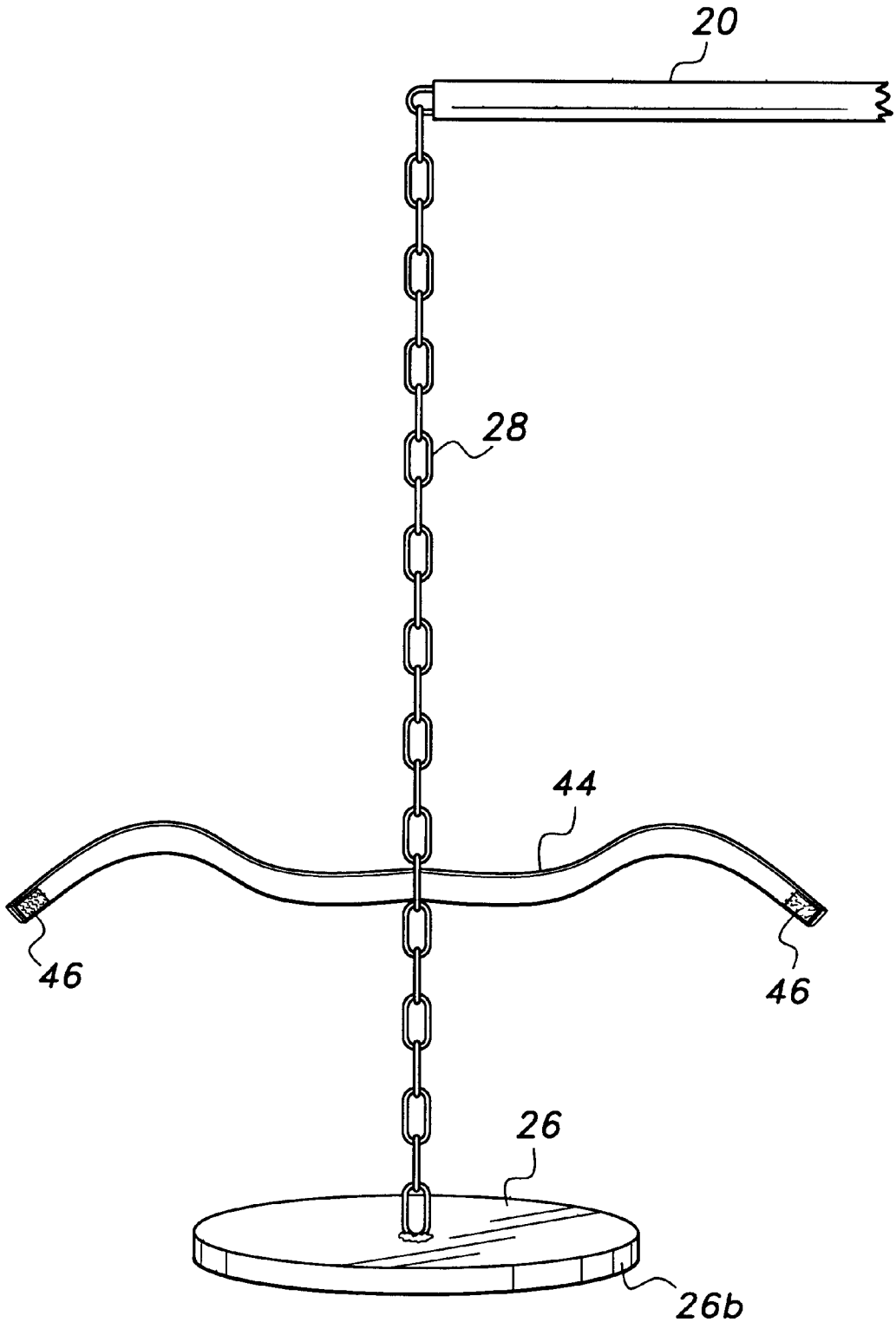
FIG. 4 is a partial view of the seat structure of a merry-go-round apparatus according to the present invention.

As best seen in FIG. 4, seat 26 is fabricated as a plate-like member which may be fabricated of any suitable material (metal, plastic, etc.). The edge 26*b* of the seat is rounded to enhance comfort. Safety strap 44 is attached to chain 28 so that a child may be safely secured in the seat. Hook and loop fasteners 46 are provided on the ends of the straps for easy fastening and unfastening. Although only two seats are shown, it is obvious that multiple pairs of seats could be utilized if the apparatus is properly balanced.

Operation of the device is safe and uncomplicated. The rider or riders are strapped into the seats. The person providing the motive power When steps over the safety barrier and propels the spin ring (by running with the ring, if desired) at a suitable speed to create a "fun" ride.

It is to be understood that the present invention is not limited to the embodiment described above, but encompasses any and all embodiments within the scope of the following claims.

I claim:

1. An amusement apparatus adapted to be inserted in the ground of an outdoor play area, said apparatus comprising:

a support shaft, said support shaft having an upper end and a lower end, said lower end extending below ground level;

a rotating shaft, said rotating shaft having a first end and a second end;

means for mounting said first end of said rotating shaft on said upper end of said support shaft;

means for manually propelling said rotating shaft;

a frame structure, said frame structure mounted to said rotating shaft;

a pair of seat members, said pair of seat members suspended from said frame structure;

a safety barrier, said safety barrier surrounding said support shaft at ground level and disposed in a radial area between said support shaft and said seat members.

2. The amusement apparatus as recited in claim 1, wherein said means for mounting includes a pipe attached to the upper end of said support shaft, said pipe configured to receive said first end of said rotating shaft.

3. The amusement apparatus as recited in claim 2, wherein said means for manually propelling includes a ring member surrounding and attached to said rotating shaft.

4. The amusement apparatus as recited in claim 3, wherein said means for manually propelling includes an array of struts, said array of struts having upper ends attached to said rotating shaft and having lower ends attached to said ring member.

5. The amusement apparatus as recited in claim 4, wherein said frame structure includes a pair of arms, each arm of said pair having a first end attached to said rotating shaft and a free end.

6. The amusement apparatus as recited in claim 5, wherein each arm of said pair extends in a horizontal, diametrically opposite plane.

7. The amusement apparatus as recited in claim 6, wherein a chain is attached to each said free end.

8. The amusement device as recited in claim 7, wherein one of said pair of seats is suspended on each said chain.

9. The amusement device as recited in claim 8, wherein each said pair of seats is of a plate-like configuration; and a quick release seat belt positioned adjacent each said pair of seats.

10. The amusement apparatus as recited in claim 9, wherein said safety barrier includes an annular member;

a plurality of stakes, said annular member being supported above ground level by said plurality of stakes;

a mesh netting, said mesh netting attached to said annular member and extending downward therefrom.

11. An amusement apparatus adapted to be inserted in the ground of an outdoor play area, said apparatus comprising:

a support shaft, said support shaft having an upper end and a lower end, said lower end extending below ground level;

an anchoring system, said anchoring system disposed adjacent said lower end of said support shaft;

a rotating shaft, said rotating shaft having a first end and a second end;

means for mounting said first end of said rotating shaft on said upper end of said support shaft;

means for manually propelling said rotating shaft;

a frame structure, said frame structure mounted to said rotating shaft;

a pair of seat members, said pair of seat members suspended from said frame structure;

a safety barrier, said safety barrier surrounding said support shaft at ground level and disposed in a radial area between said support shaft and said seat members.

12. The amusement apparatus as recited in claim 11, wherein said anchoring system includes an array of pipes attached to said support shaft and extending radially therefrom.

13. The amusement apparatus as recited in claim 12, wherein said lower end of said support shaft and said array of pipes are encased in concrete.

14. The amusement apparatus as recited in claim 13, wherein said means for mounting includes a vertically positioned pipe attached to the upper end of said support shaft, said vertically positioned pipe configured to receive said first end of said rotating shaft.

15. The amusement apparatus as recited in claim 14, wherein said means for manually propelling includes a ring member surrounding and attached to said rotating shaft.

16. The amusement apparatus as recited in claim 15, wherein said means for manually propelling includes an array of struts having upper ends attached to said rotating shaft and having lower ends attached to said ring member.

17. The amusement apparatus as recited in claim 16, wherein said frame structure includes a pair of arms, each arm of said pair having a first end attached to said rotating shaft and a free end and wherein each arm of said pair extends in a horizontal, diametrically opposite plane.

18. The amusement apparatus as recited in claim 17, wherein a chain is attached to each said free end and wherein one of said pair of seats is suspended on each said chain.

19. The amusement apparatus as recited in claim 18, wherein each said pair of seats is of plate-like configuration; and a quick release seat belt positioned adjacent each said pair of seats.

20. The amusement apparatus as recited in claim 19, wherein said safety barrier includes an annular member;

a plurality of stakes, said annular member being supported above ground level by said plurality of stakes;

a mesh netting, said mesh netting attached to said annular member and extending downward therefrom.

* * * * *